US006622438B2

(12) United States Patent
Hurlock

(10) Patent No.: US 6,622,438 B2
(45) Date of Patent: Sep. 23, 2003

(54) TEMPORARY INSTALLATION SUPPORT DEVICE FOR SHEET MATERIAL

(76) Inventor: Christopher Paul Hurlock, 67 Forest St., Unionville, CT (US) 06085

( * ) Notice: Subject to any disclaimer, the term of this patent is extended or adjusted under 35 U.S.C. 154(b) by 0 days.

(21) Appl. No.: 09/797,439

(22) Filed: Mar. 1, 2001

(65) Prior Publication Data

US 2002/0121070 A1 Sep. 5, 2002

(51) Int. Cl.[7] ..... E04G 21/04; E04G 21/14; F16M 11/00

(52) U.S. Cl. ..... 52/127.2; 52/127.1; 248/200

(58) Field of Search ..... 52/DIG. 1, 749.1, 52/749.11, 127.1, 127.2, 606, 608, 609, 610; 248/200, 250, 247; 24/570

(56) References Cited

U.S. PATENT DOCUMENTS

| | | | | | |
|---|---|---|---|---|---|
| 1,798,734 | A | * | 3/1931 | Heath | 52/610 |
| 2,185,497 | A | * | 1/1940 | Cilento | 52/610 |
| 3,046,700 | A | * | 7/1962 | Davenport | |
| 3,387,814 | A | * | 6/1968 | Fischer | |
| 4,314,429 | A | * | 2/1982 | Casteel | |
| 4,449,338 | A | * | 5/1984 | Reicherts | |
| 4,811,926 | A | * | 3/1989 | Marsh | |
| 5,224,309 | A | * | 7/1993 | Bodell | |
| 5,249,405 | A | | 10/1993 | Miller | |
| 5,371,994 | A | * | 12/1994 | Waters | |
| 5,407,183 | A | | 4/1995 | Singeltary | |
| 5,417,017 | A | * | 5/1995 | Toutountzis | 52/101 |
| 5,564,236 | A | * | 10/1996 | McKinney | |
| 5,884,447 | A | * | 3/1999 | Earp | |
| 6,131,361 | A | | 10/2000 | Murphy | |

FOREIGN PATENT DOCUMENTS

| | | | | |
|---|---|---|---|---|
| GB | 2 346 388 A | * | 8/2000 | E04B/2/26 |

* cited by examiner

*Primary Examiner*—Carl D. Friedman
*Assistant Examiner*—Kevin McDermott
(74) *Attorney, Agent, or Firm*—David Arnold

(57) ABSTRACT

A temporary support device for installing sheet material in a building construction is provided with a multitude of perpendicular surfaces and a pair of offset surfaces for temporarily supporting a variety of sheet materials in a variety of orientations. Countersunk through holes integral to the support device accept standard screw hardware for temporarily mounting the support device to the building substructure. The pair of offset surfaces provide clearance for loosely supporting the sheet material before final securement of the sheet to the building substructure. The support device may be manufactured out of lightweight material, such as, for example, aluminum, wood, or plastic, and may include cored out sections, thereby enhancing the utility and handling of the device. Materials that can be temporarily supported by the support device include, but are not limited to, sheetrock, insulation board, plywood, and particle board.

15 Claims, 3 Drawing Sheets

TEMPORARY INSTALLATION SUPPORT DEVICE FOR SHEET MATERIAL

FIELD OF THE INVENTION

The present invention relates generally to a support device for temporarily holding construction sheet material in place prior to final securement, and, more particularly, to a stepped or offset support device with an orthogonal set of planar surfaces capable of temporarily supporting construction sheet material, such as gypsum board, in a vertical, horizontal, or angular orientation prior to final securement of the sheet.

BACKGROUND OF THE INVENTION

Temporary support devices for construction sheet material have the general function of temporarily supporting sheet material such as gypsum board (also known as sheetrock or drywall board) prior to final securement of the sheet material to the underlying support structure. Such sheet materials are commonly used in residential, commercial and industrial buildings for covering walls or ceilings and are manufactured in standard sizes, such as 4×8 feet or 4×12 feet. Due to the size and weight of these sheet materials, fastening of the sheets to horizontal, vertical, or angular studs, joists, rafters or trusses can be tiring and awkward, especially when only one or two installers are on the job site.

To assist in the installation of such construction sheet material, various temporary support devices have been employed. A commonly known temporary support is the "dead man" brace, which is typically fabricated from at least two pieces of 2×4 stud lumber in a "T" orientation, and is generally used to temporarily support sheetrock during ceiling installation. This type of temporary support is generally fabricated on the job site in order to accommodate a specific height dimension, is large and cumbersome in its size, and is not easily transported from one job site to the next.

U.S. Pat. No. 5,224,309 entitled "Temporary Cleat For Sheet Goods" describes a relatively thin and wide multipiece assembly that temporarily supports sheet material and is adjustable to accommodate sheet material of various thicknesses. This type of temporary support is relatively costly in comparison to other supports not involving multipiece assemblies.

U.S. Pat. No. 5,249,405 entitled "Drywall Support" describes a relatively thin and wide unitary device with a right angle offset and a piercing end for the temporary support of drywall material. The piercing end can be inserted into the underlying support structure to various depths by a skilled artisan, thereby accommodating various sheet thicknesses. This type of temporary support relies on a single anchor point and requires a degree of skill for adequate, yet not excessive, depth of insertion in the underlying support structure.

U.S. Pat. No. 5,407,183 entitled "Drywall Installation Tool" describes a relatively thin and wide unitary device with a flat leg having two mounting holes and an angled leg having a frictional surface for the temporary support of drywall material. Accurate placement of the installation tool by a skilled artisan will produce a variety of distances between the underlying support structure and the angled leg, thereby accommodating various sheet thicknesses. This type of temporary support requires a degree of skill for appropriate placement of the tool with regard to the distance between the drywall to be installed and the angled surface of the tool.

U.S. Pat. No. 6,131,361 entitled "Displaceable Support Bracket For Drywall Panel Installation" describes relatively thin and wide unitary devices having a long flat leg and a short right-angled leg, or a long flat leg and a short offset leg, or a long flat leg, a short right-angled leg, and a short offset leg, for the temporary support of drywall material. Keyhole features in the long flat leg provide a way to temporarily fasten the support bracket to the underlying support structure. This type of temporary support provides limited surface engagement for large sheets, thereby increasing the number of brackets required for large sheet installations, and, since this type of temporary support is typically fabricated from a metallic material, multiple brackets would result in an increase of weight that a single installer would be required to handle when installing large sheets.

Thus, it would be beneficial to provide a support device for temporarily supporting a variety of construction sheet materials that is compact and easily transported, of unitary construction for low cost, provides a plurality of anchor points, requires limited skill in its use, has broad surface engagement for large sheet installations, and is fabricated from lightweight material in order to minimize the combined weight when multiple supports are used by an individual installer.

BRIEF SUMMARY OF THE INVENTION

In an exemplary embodiment of the present invention, a temporary support device for installing sheet material in a building construction is provided with a multitude of rectangular and perpendicular surfaces and a rectangular pair of offset surfaces for temporarily supporting a variety of sheet materials in a variety of orientations. The temporary support device is provided with large surface areas having a width dimension in excess of the thickness of a sheet of construction material to provide a degree of surface engagement that distributes the stress of the construction sheet material over a large surface area, thereby minimizing damage to the edge of the construction sheet material. For example, when sheetrock is supported on its edge by a narrow object, the weight of the sheetrock on the narrow edge will cause an overstress condition to the sheetrock, thereby resulting in damage to the edge of the sheetrock, which is an undesirable condition.

Countersunk through holes integral to the support device accept standard screw hardware for temporarily mounting the support device to the building substructure. The pair of offset surfaces provide clearance for loosely supporting the sheet material before final securement of the sheet to the building substructure. The support device may be provided with cored out sections, thereby enhancing the utility and handling of the device by providing through holes for hanging the support device and by reducing the overall weight of the support device.

The support device may be manufactured out of lightweight machinable or castable material, such as, for example, machinable aluminum, extruded aluminum, aluminum diecast, zinc diecast, or wood. Alternatively, the support device may be manufactured out of a lightweight and moldable material, such as, for example, thermoset plastic or thermoplastic plastic. Suitable thermoset plastics would include, but are not limited to, polyester, polyester-glass, phenolic, phenolic-glass, epoxy, epoxy-glass, melamine, or melamine-glass. Suitable thermoplastic plastics would include, but are not limited to, polyethylene, polypropylene, polystyrene, polyester, polyvinyl chloride (PVC), acrylics, nylons, spandex-type polyurethanes, polyamides, polycarbonates, fluorocarbons, acrylonitrile-butadiene-styrene (ABS), acetal, and cellulosics.

Materials that can be temporarily supported by the support device include, but are not limited to, gypsum board (also known as sheetrock or drywall board), plywood, particle board, bead board (representative of wanes coating), fiber board, or sheet insulation, where the thickness of the sheets range, for example, from ⅛ inch to 1½ inch.

The support device of the present invention has the advantage of being a unitary device fabricated from a lightweight material, but of sufficient design and strength to support at least a portion of the weight of a sheet of construction material, of having a compact design for ease of transportation, of requiring limited skill in its use, of having broad surface engagement for large sheet installations, and of being of low cost.

DESCRIPTION OF THE PREFERRED EMBODIMENT

Temporary Support Device

Figure 1:
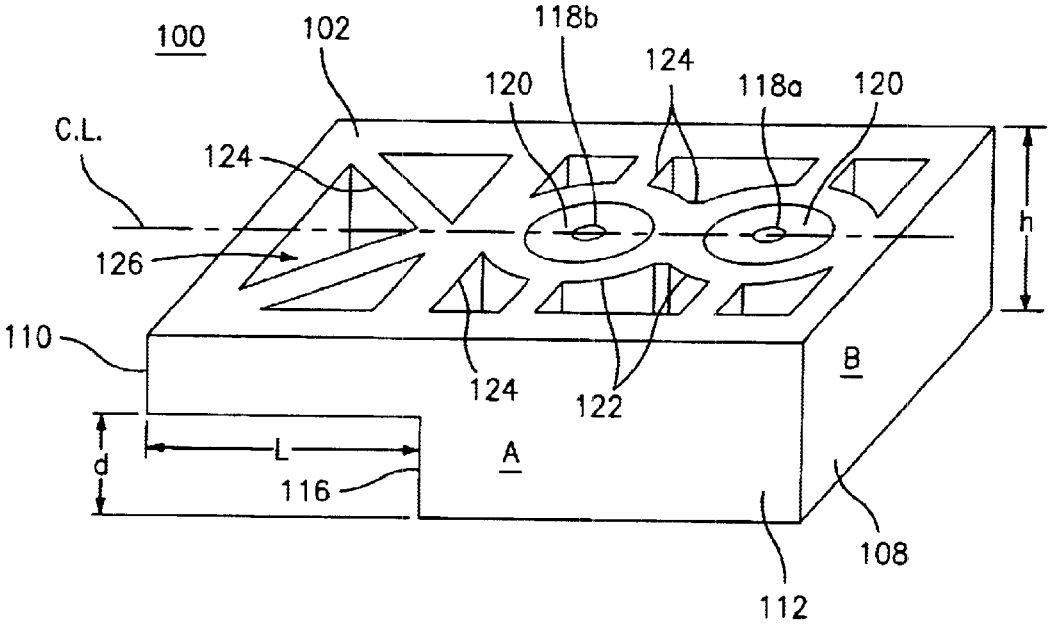
FIG. 1 illustrates a first perspective view of a temporary support device incorporating the features of the present invention.
Figure 2:
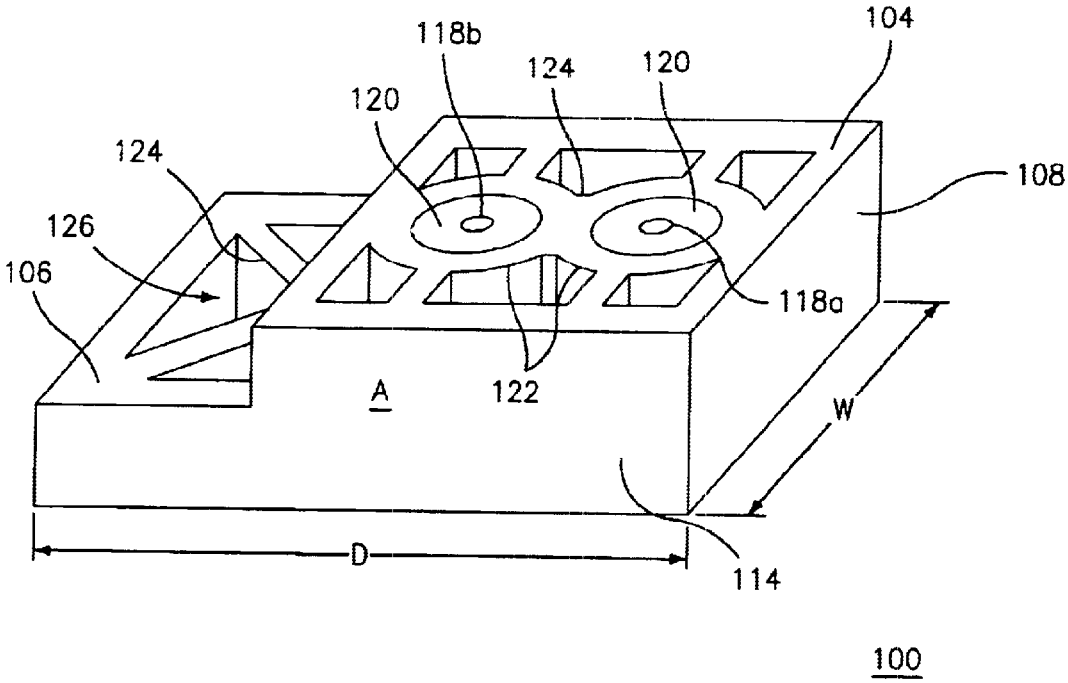
FIG. 2 illustrates a second perspective view of the temporary support device of FIG. 1.

Referring to FIGS. 1 and 2, a generally rigid box shaped structure 100 is constructed having a first planar surface 102, a second planar surface 104, and a third planar surface 106, conjoined by end wall sections 108 and 110, side wall sections 112 and 114, and step riser wall section 116. The substantially perpendicular relationship of planar surfaces 102, 104, and 106 to wall sections 108, 110, 112, 114, and 116, accommodating both part tolerances and mold draft angles, result in planar surfaces 104 and 106 being in stepped relationship to one another, and planar surfaces 104 and 106 being in an opposing relationship with planar surface 102, or alternatively, planar surfaces 104 and 106 being in a face-to-face relationship with planar surface 102. As a result of the foregoing, planar surfaces 104 and 106 are substantially parallel to planar surface 102.

The step riser wall section 116 creates a predefined offset "d" between planar surfaces 104 and 106. The predefined offset "d" is provided to create a clearance condition between planar surface 106 and a sheet of temporarily supported construction material 202, as seen by referring to FIG. 3, when planar surface 104*b* of temporary support device 100*b* is held in surface contact with construction material 200 by mounting hardware 128. The temporarily supported sheet material 202 is loosely supported in order to provide the installer with the ability to maneuver the sheet material 202 into its final position on wall studs 208 prior to final securement. The predefined offset "d" is preferably between 1/16 and 9/16 inches, more preferably between ⅛ and 7/16 inches, even more preferably between 3/16 and 5/16 inches, and is most preferably ¼ inch. In general, variations from any noted preferred dimensions, such as but not limited to part tolerances, that do not detract from the intended function of the temporary support device are considered within the scope of the invention.

Figure 3:
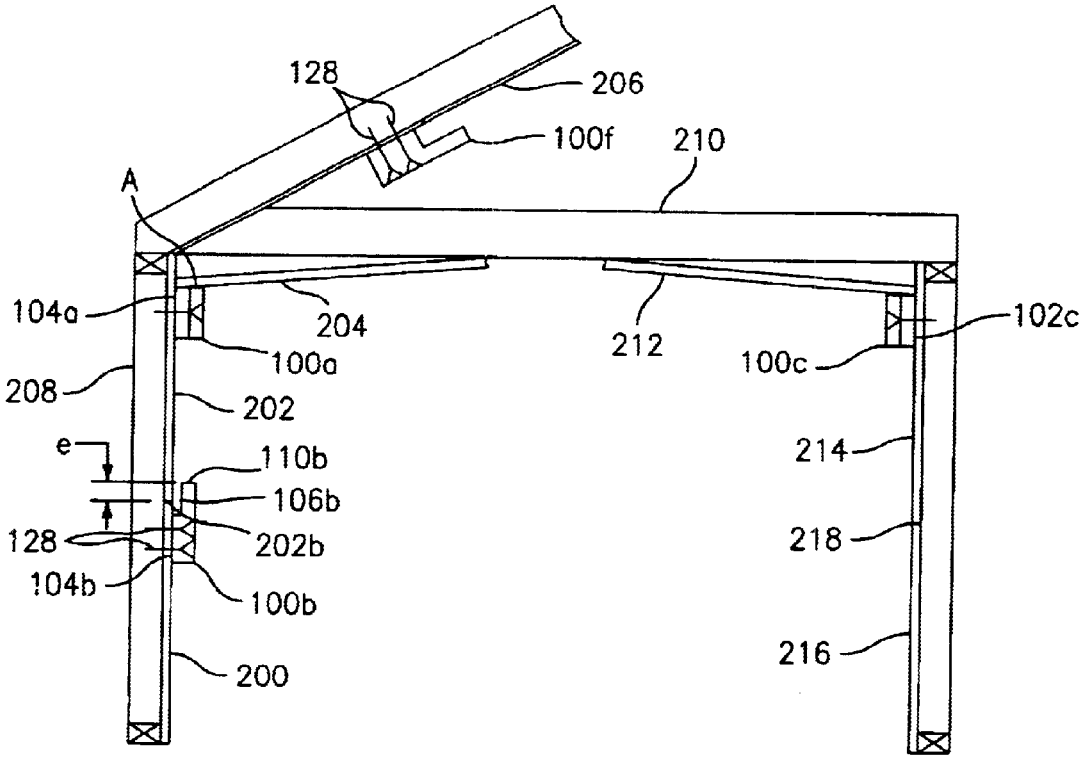
FIG. 3 illustrates a partial side elevation view of a plurality of the temporary support devices of FIG. 1 temporarily supporting sheet material on a wall, an angled ceiling, and a horizontal ceiling.

The height of end wall section 108, as illustrated by dimension "h" in FIG. 1, provides broad surface areas, as illustrated by surfaces "A" on side wall sections 112 and 114, and surface "B" on end wall section 108, to distribute the contact stress when the weight of a panel of sheet material is supported by either surface A or B, as illustrated in FIG. 3 where surface A of temporary support device 100*a* is shown in a supporting relationship with sheet material 204 for a ceiling installation on ceiling joists 210. The dimension "h" is desirably greater than the thickness of a typical sheet of sheetrock material, which is generally between ⅜ and ⅝ inches. Thus, dimension "h" is preferably between ¾ and 2 inches, more preferably between ⅞ and 1¾ inches, even more preferably between 1 and 1½ inches, and is most preferably 1⅛ inches.

The length "L" of planar surface 106 provides for sufficient engagement of a panel of sheet material during the temporary supporting of the sheet material, as illustrated in the wall installation of FIG. 3 where length "L" engages sheet material 202 by dimension "e". The engagement dimension "e" is generally chosen by the installer, but is usually less than or equal to length "L". In order to provide for sufficient engagement "e", length "L" is desirably, but not necessarily, equal to or greater than 1½ times the thickness of a typical sheet of sheetrock material. Thus, length "L" is preferably between ¾ and 2 inches, more preferably between ⅞ and 1¾ inches, even more preferably between 1 and 1½ inches, and is most preferably 1¼ inches.

The dimensions "W", "D" and "L", which define planar surface 104, provide for a sufficient surface area of engagement between planar surface 104 and the underlying panel of sheet material, as shown by 100*b* and 200 in FIG. 3, such that securement of mounting hardware 128 through generally rounded bore holes 118*a,b* adequately secure temporary support device 100*b* against the sheet material 200 without overstressing the sheet material 200, thereby preventing undesirable pressure indentations on the sheet material 200. Planar surface 104 is typically in face contact with the sheet material 200 during wall construction, as shown by 104*b* and 200 in FIG. 3, but either planar surfaces 102 or 104 may be in face contact with the underlying sheet material during ceiling construction, as shown by 104*a* and 202, and 102*c* and 214. Dimensions "W", "D" and "L" are also chosen so as to provide for generally rounded bore holes 118*a,b*. Generally rounded bore holes 118*a,b* are appropriately sized to loosely accept standard sheetrock screws, which are typically #6 or #8 in size, and are substantially perpendicular to planar surfaces 102 and 104, accommodating both part tolerances and mold draft angles. Dimension "W" is preferably between 1½ and 5½ inches, more preferably between 2½ and 4½ inches, even more preferably between 3 and 4 inches, and is most preferably 3½ inches. Dimension "D" is preferably between 3½ and 8½ inches, more preferably between 4½ and 7½ inches, even more preferably between 5½ and 6½ inches, and is most preferably 6 inches.

Figure 5A:
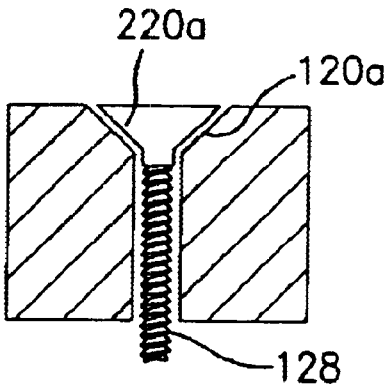
FIGS. 5A and 5B illustrate alternative partial section views through a bore hole of the temporary support device of FIG. 1.
Figure 5B:
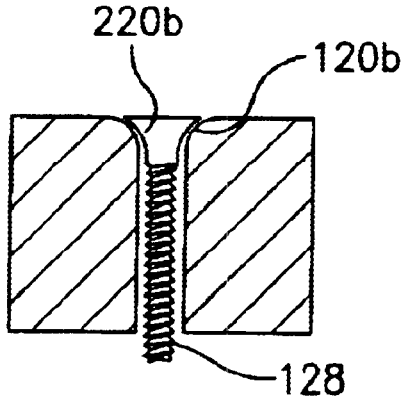

Generally rounded bore holes 118*a,b* are sized to loosely accept standard sheetrock screws, and include countersink surfaces 120 to define contoured surfaces, recessed from planar surfaces 102 or 104, that interact with the contoured surface on the underside of the flathead of a sheetrock screw, generally depicted by 128 in FIG. 3, thereby providing for distribution of the hoop stresses associated with a tightened flathead screw. FIGS. 5*a* and 5*b* show alternative embodiments of the contoured surface of countersink 120. In FIG.

5*a*, contoured surface 120*a* is generally conical in shape for accepting a standard flathead screw that has a generally conical drive head 220*a*. In FIG. 5*b*, contoured surface 120*b* is generally fluted in shape for accepting a sheetrock flathead screw that has a generally fluted drive head 220*b*.

Figure 4:
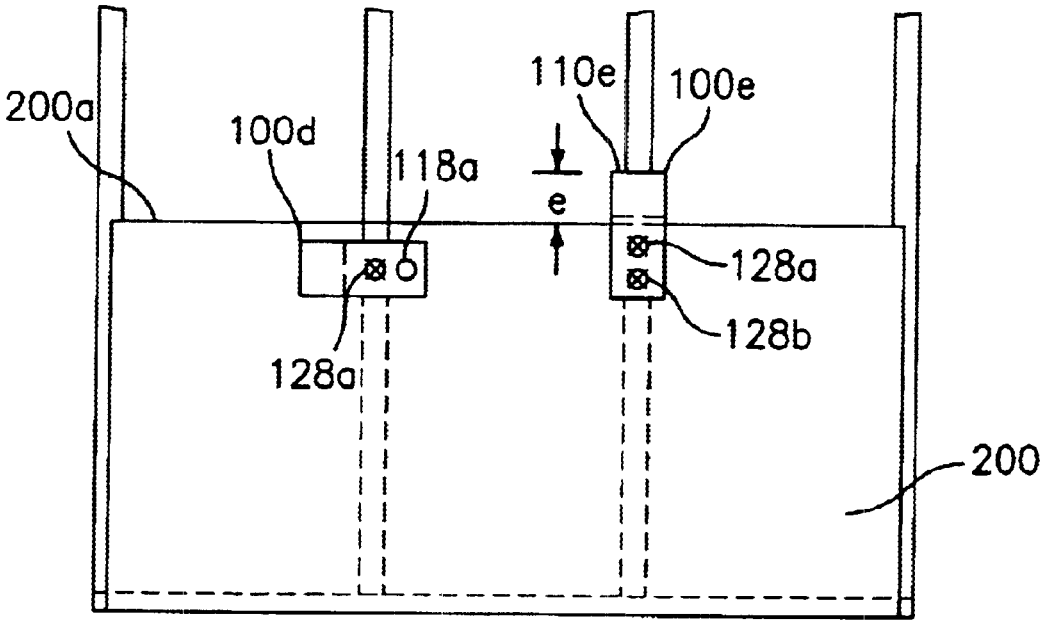
FIG. 4 illustrates a front elevation view of a plurality of the temporary support devices of FIG. 1 for temporarily supporting sheet material on a wall.

The temporary support device 100 may be provided with only one generally rounded bore hole 118, but two generally rounded bore holes 118 provide for additional securement and anti-rotation. FIG. 4 shows a first support device 100*d* with its bore holes horizontally aligned, and a second support device 100*e* with its bore holes vertically aligned. By first arranging both support devices with their respective bore holes in a horizontal alignment and securing them to the wall stud with a single fastener, as shown by 100*d* and 128*a*, a second panel of sheet material, not shown, can be put in place above the first panel 200, and then the support devices can be rotated in a vertical orientation, as shown by 100*e*, for final securement of the panel of sheet material. Depending on the weight of the panel of sheet material, such as sheetrock versus insulation board, one screw 128*a* may be used, or two screws 128*a*, 128*b* may be used. The desire to use two screws for support and anti-rotation may be of more significance when installing sheetrock on a vaulted or cathedral ceiling, as shown in the foreground in FIG. 3 by 100*f* and 206, since the support device must support a substantial portion of the weight of the supported panel 206. FIG. 3 illustrates a cathedral ceiling arrangement in the foreground, and a horizontal ceiling arrangement in the background.

Generally rounded bore holes 118*a,b* are located on an imaginary central line "C.L." that bisects the edge of surface "B" and runs central to planar surface 102. A first bore hole 118*a* is proximate the end wall section 108, and a second bore hole 118*b* is proximate the predefined offset "d" that defines the step riser wall 116 between planar surfaces 104 and 106. Bore holes 118*a,b* are surrounded by cylindrical rib sections 122. Rib sections 122 are conjoined with each other and wall sections 108, 110,112, 114 and 116 by planar rib sections 124. In-between rib sections 122 and 124 are voids 126, which are typically referred to as cored regions. Rib sections 122 and 124 are substantially perpendicular to planar surfaces 102, 104 and 106, accommodating both part tolerances and mold draft angles. The use of ribs and cored regions provide for structural integrity within the part, while optimizing material usage and part weight.

Use of Temporary Support Device

Temporary support device 100 is primarily intended for temporarily supporting one end of a panel of construction sheet material while the opposite end is being secured by the installer. FIGS. 3 and 4 show alternative arrangements where support device 100 is used to temporarily support panels for a vertical wall construction, a horizontal ceiling construction, or an angled ceiling construction (vaulted or cathedral ceilings). As shown in FIG. 4, the support device 100*e* may be initially oriented vertically, with imaginary line "C.L." oriented perpendicular to the panel edge 200*a*, thereby establishing an engagement dimension "e". Alternatively, support device 100*d* may be initially oriented horizontally, with imaginary line "C.L." oriented parallel to the panel edge 200*a*, and then moved to a vertical orientation to establish an engagement dimension "e". Sheetrock screws 128 are fastened through bore holes 118*a,b* to temporarily secure support device 100 to the underlying substructure, which may comprise sheetrock, wall studs, ceiling joists, scissor truss joists, or roof rafters.

If the vertical orientation of support device 100*e* in FIG. 4 is initially employed, the lower edge 202*b* of the panel of sheet material 202 to be installed must first be lifted over the end 110*b* of support device 100*b* and then placed in spaced relationship to planar surface 106*b*, as best seen by referring to 100*b* and 202 in FIG. 3. FIG. 3 also shows lower edge 202*b* of panel 202 abutting top edge of panel 200, where the abutting edges are identified by the lower dimension line of engagement dimension "e", or alternatively identified by the demarcation line 218 between panels 214 and 216. Once the first lower edge 202*b* of the panel of sheet material 202 is temporarily supported by support device 100*b*, the opposite edge can be readily secured by the installer by sheetrock screws, or the equivalent, not shown.

If the horizontal orientation of support device 100*d* in FIG. 4 is initially employed, the lower edge of the panel of sheet material 202 to be installed, shown in FIG. 3, can be simply moved into position to abut the upper edge of the bottom panel 200 already in place. The support device is then vertically oriented as shown by 100*e* in FIG. 4 and the panel 202 secured in place by sheetrock screws, or the equivalent, not shown.

Installation of a panel of sheet material on a horizontal ceiling is best done by using the support device in a horizontal orientation, as shown by 100*a* and 204 in FIG. 3. Since the dimensions "h" and "D" of support device 100 are selected to produce a broad support surface area, represented by surface "A", use of surface "A" to support ceiling panel 204 will provide for greater distribution of the stresses resulting from the weight of ceiling panel 204 than if surface "B" were used. Thus, use of surface "A" as opposed to surface "B" will permit fewer support devices 100 to be used for installing the ceiling panels.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A support device for temporarily supporting sheet material comprising:

a first surface;

a second and a third surface opposing said first surface;

wherein said second surface is further removed front said first surface than said third surface by an offset;

wherein said first and second surfaces have at least two holes therethrough adapted to receive and restrain at least one of a flat head screw and a sheet rock screw;

wherein said first and second surfaces are conjoined by at least one wall comprising at least one of a first end wall, a first side wall, and a second side wall;

wherein one of said at least two holes is proximate said first end wall and another of said at least two holes is proximate said offset;

wherein said first side wall is arranged parallel to said second side wall, said first and second parallel side walls defining a centerline therebetween;

wherein said at least two holes are disposed on said centerline;

a plurality of ribs substantially perpendicular to said first surface and to said second and third surfaces; and at least two generally cylindrical ribs substantially perpendicular to said first surface and to said second surface and having one each of said at least two holes therethrough;

whereby the insertion of at least one of a fiat head screw and a sheet rock screw through at least one of said at least two holes is capable of temporarily securing said support device to a structure, said at least one of a flat head screw and a sheet rock screw being received and restrained by at least one of said at least two boles.

2. The support device of claim 1, wherein;

said at least two holes comprises a pair of holes.

3. The support device of claim 2, wherein;

said first and second surfaces have surface profiles at least one end of each of said pair of holes adapted to receive and restrain the head profile of at least one of a flat head screw and a sheetrock screw.

4. The support device a claim 3, wherein;

said surface profile is selected from the group consisting of a conical profile and a fluted Profile.

5. The support device of claim 1, wherein;

said plurality of ribs, said at least one wall, and said at least two generally cylindrical ribs are conjoined; and wherein said plurality of ribs, said at least one wall, and said at least two generally cylindrical ribs define voids therebetween.

6. The support device of claim 1, wherein;

said support device is made from a material selected from the group consisting of machinable aluminum, extruded aluminum, aluminum diecast, zinc diecast, and wood.

7. The support device of claim 1, wherein;

said support device is made from a material selected from the group consisting of thermoplastic plastic, thermoset plastic, polyester, polyester-glass, phenolic, phenolic-glass, epoxy, epoxy-glass, melamine, melamine-glass, polyethylene, polypropylene, polystyrene, polyester, polyvinyl chloride, acrylics, nylons, PVC, ABS, spandex-type polyurethanes, polyamides, polycarbonates, fluorocarbons, and cellulosics.

8. A support device for temporarily supporting sheet material comprising:

a first surface;

a second and a third surface opposing said first surface;

wherein said second surface is further removed from said first surface than said third surface by an offset "d";

wherein said first and said second surfaces are separated by a dimension "h";

wherein said first, second and third surfaces are conjoined by at least one walls said at least one wall comprising at least one of a first side wall, a second side walls, a first end wall, a second end walls, and a step riser wall;

wherein said first and second side walls are separated by a dimension "W";

wherein said first and second end walls are separated by a dimension "D";

wherein said second end wall and said step riser wall are separated by a dimension "L";

wherein said first and second surfaces have a pair of holes therethrough, each of said pair of holes having a circular cross section;

wherein one of said holes is proximate said first end wall and the other of said holes is proximate said step riser wall;

wherein said first side wall is arranged parallel to said second side wall, said first and second parallel side walls defining a centerline therebetween;

wherein said pair of holes are disposed on said centerline; and wherein said first and second surfaces have surface profiles at least one end of each of said pair of holes adapted to receive and restrain the head profile of at least one of a flat head screw and a sheetrock screw whereby the insertion of at least one of a flat head screw and a sheet rock screw through at least one of said pair of holes is capable of temporarily securing said support device to a structure, said at least one of a flat head screw and a sheetrock screw being received and restrained by at least one of said pair of holes.

9. The support device of claim 8, further comprising;

a plurality of ribs substantially perpendicular to said first surface and to said second and third surfaces;

a pair of generally cylindrical ribs substantially perpendicular to said first surface and said second surface and having one each of said holes therethrough;

wherein said plurality of ribs, said at least one wall, and said pair of generally cylindrical ribs are conjoined; and wherein said plurality of ribs, said at least one wall, and said pair of generally cylindrical ribs define voids therebetween.

10. The support device of claim 8, wherein;

said dimension "d" is between about 1/16 and about 9/16 inches;

said dimension "h" is between about ¾ and about 2 inches;

said dimension "W" is between about 1½ and about 5½ inches;

said dimension "D" is between about 3½ and about 8½ inches; and said dimension "L" is between about ¾ and about 2 inches.

11. The support device of claim 8, wherein; said dimension "d" is between about ⅛ and about 7/16 inches; said dimension "h" is between about ⅞ and about 1¾ inches; said dimension "W" is between about 2½ and about 4½ inches;

said dimension "D" is between about 4½ and about 7½ inches; and said dimension "L" is between about ⅞ and about 1¾ inches.

12. The support device of claim 8, wherein;

said dimension "d" is between about 3/16 and about 5/16 inches;

said dimension "h" is between about 1 and about 1½ inches;

said dimension "W" is between about 3 and about 4 inches;

said dimension "D" is between about 5½ and about 6½ inches; and said dimension "L" is between about 1 and about 1½ inches.

13. The support device of claim 8, wherein;

said dimension "d" is about ¼ inches;

said dimension "h" is about 1⅛ inches;

said dimension "W" is about 3½ inches;

said dimension "D" is about 6 inches; and said dimension "L" is about 1¼ inches.

14. A support device for temporarily supporting sheet material comprising:

a first substantially box shaped end;

a second substantially box shaped end smaller than said first box shaped end;

wherein said first and second box shaped ends are conjoined to define a step with a step riser wall and first and second planar side walls, wherein said first planar side wall is arranged parallel to said second planar side wall, and wherein said first and second planar side walls define a centerline therebetween;

wherein said first box shaped cud has a first hole and a second hole therethrough, each of said first and second holes having a circular cross section and adapted to receive and restrain at least one of a flathead screw and a sheetrock screw, and wherein said first hole is further removed from said stop riser wall than said second hole, and said first and second holes are disposed on said centerline;

whereby the insertion of at least one of a flat head screw and a sheet rock screw through at least one of said holes is capable of temporarily securing said support device to a structure, said at least one of a flat head screw and a sheet rock screw being received and restrained by at least one of said holes.

15. The support device of claim 14, wherein;

said first box shaped end has surface profiles at at least one and ends of said first and second of holes adapted to receive and restrain the the head profile of at least one of a flat head screw and a sheetrock screw.

* * * * *